US009103309B2

(12) United States Patent
Yoshimura et al.

(10) Patent No.: US 9,103,309 B2
(45) Date of Patent: Aug. 11, 2015

(54) FUEL INJECTION VALVE

(71) Applicant: Hitachi Automotive Systems, Ltd., Hitachinaka-shi, Ibaraki (JP)

(72) Inventors: Kazuki Yoshimura, Hitachinaka (JP); Yoshio Okamoto, Omitama (JP); Eiji Ishii, Hitachinaka (JP); Noriyuki Maekawa, Kashiwa (JP); Takahiro Saito, Isesaki (JP); Atsushi Nakai, Isesaki (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 52 days.

(21) Appl. No.: 13/951,002

(22) Filed: Jul. 25, 2013

(65) Prior Publication Data

US 2014/0027542 A1 Jan. 30, 2014

(30) Foreign Application Priority Data

Jul. 27, 2012 (JP) ..... 2012-166489

(51) Int. Cl.
*F02M 61/16* (2006.01)
*F02M 61/18* (2006.01)

(52) U.S. Cl.
CPC ..... *F02M 61/163* (2013.01); *F02M 61/162* (2013.01); *F02M 61/186* (2013.01); *F02M 61/1806* (2013.01); *F02M 61/1846* (2013.01); *F02M 61/1853* (2013.01)

(58) Field of Classification Search
CPC ..... F02M 61/1806; F02M 61/182; F02M 61/184; F02M 61/1846; F02M 61/1853; F02M 61/186
USPC ..... 239/463, 468, 486, 487, 490, 491, 493, 239/494, 533.2, 533.3, 533.12, 584, 585.1, 239/585.4, 585.5, 596, 601
See application file for complete search history.

(56) References Cited

U.S. PATENT DOCUMENTS

| | | | | |
|---|---|---|---|---|
| 3,680,793 | A * | 8/1972 | Tate et al. | 239/468 |
| 6,142,390 | A * | 11/2000 | Nordstrom et al. | 239/490 |
| 6,405,945 | B1 * | 6/2002 | Dobrin | 239/463 |

(Continued)

FOREIGN PATENT DOCUMENTS

| | | | |
|---|---|---|---|
| JP | 2003-336562 | A | 11/2003 |
| JP | 2008-280981 | A | 11/2008 |
| JP | 2012-158995 | A | 8/2012 |

OTHER PUBLICATIONS

Takefumi Namai, "Turbofan and Compressor", 1960 (Four (4) pages).

*Primary Examiner* — Ryan Reis
(74) *Attorney, Agent, or Firm* — Crowell & Moring LLP

(57) ABSTRACT

A fuel injection valve is disclosed with enhanced uniformity of a swirl flow in the circumferential direction. The valve includes a swirling chamber having an inner wall surface with a helical curve and a swirling passage for guiding fuel into the chamber. The valve is formed such that the center of a circle as the basis of the helical curve and the center of a fuel injection hole open in the swirling chamber align with one another. The joint between the passage for swirling and the inner circumferential wall on the downstream side of the chamber at which both walls intersect is positioned between a line from the center of the hole to a point at which the curvature of the swirling chamber shape starts to change; and a tangent line of the side wall of the hole so drawn that it is in parallel to the line segment.

6 Claims, 10 Drawing Sheets

(56) References Cited

U.S. PATENT DOCUMENTS

2003/0141385 A1* 7/2003 Xu ..... 239/463
2003/0234005 A1* 12/2003 Sumisha et al. ..... 123/467
2011/0233307 A1* 9/2011 Ohno et al. ..... 239/463
2012/0193566 A1 8/2012 Yasukawa et al.

* cited by examiner

FUEL INJECTION VALVE

CLAIM OF PRIORITY

The present application claims priority from Japanese Patent application serial No. 2012-166489, filed on Jul. 27, 2012, the content of which is hereby incorporated by reference into this application.

FIELD OF THE INVENTION

The present invention relates to fuel injection valves used in internal combustion engines and to a fuel injection valve in which atomization capability can be enhanced by injecting swirling fuel.

BACKGROUND OF THE INVENTION

As a conventional technology for utilizing a swirl flow to facilitate the atomization of fuel injected from multiple fuel injection holes, the fuel injection valve described in Patent Document 1 (JP-A-2003-336562) is known.

In this fuel injection valve, a lateral passage and a swirl chamber are formed between a valve seat member and an injector plate. At the front end face of the valve seat member, the downstream end of a valve seat cooperating with a valve body is open and the injector plate is joined to the front end face of the valve seat member. The lateral passage communicates with the downstream end of the valve seat and the downstream end of the lateral passage is open in the tangential direction of the swirl chamber. A fuel injection hole for injecting fuel given a swirl in the swirl chamber is formed in the injector plate. The fuel injection hole is placed so that it is offset a predetermined distance from the center of the swirl chamber to the upstream end side of the lateral passage.

In this fuel injection valve, the curvature radius of the inner circumferential surface of the swirl chamber is reduced from the upstream side to the downstream side in the direction along the inner circumferential surface of the swirl chamber. That is, the curvature is increased from the upstream side to the downstream side in the direction along the inner circumferential surface of the swirl chamber. In addition, the inner circumferential surface of the swirl chamber is formed along an involute curve having its base circle on the swirl chamber. As a result, the facilitation of the atomization of fuel and the enhancement of injection response are achieved.

The fuel injection valve described in Patent Document 2 (JP-A-2008-280981) includes an orifice plate having: multiple perfectly circular swirling chambers (swirl chambers) for swirling fuel; fuel injection holes for injecting fuel; and fuel inflow passages for guiding fuel into the swirling chambers. The offset of each fuel injection hole from the central axis of a fuel inflow passage is made larger than the width of the fuel inflow passage and a curved spray group is thereby formed. Thus HC of exhaust gas is reduced by reducing fuel sticking to a wall surface. Further, soot is reduced to achieve the enhancement of the power of an internal combustion engine by injecting fuel with high dispersion.

One of products similar to the shape of the swirling chamber in the orifice plate of a fuel injection valve is the scroll of a centrifugal blower (compressor) as is found in Non-patent Document 1 ("Turbofan and Compressor," Takefumi Namai). As one of basic design methods for centrifugal blowers, its shape is prescribed so that the flow rate is conserved at each section of the scroll. This makes it possible to define such a shape of the scroll that pressure loss is reduced and even turning is accomplished.

SUMMARY OF THE INVENTION

With a swirling chamber shape based on involute curve or perfect circle as described in Patent Document 1 or Patent Document 2, a swirl flow is insufficient in uniformity. The uniformity of a swirl flow has influence on the uniformity of a fuel liquid film in a fuel injection hole and relates to the production of coarse particles; therefore, it is important for fuel injection valves utilizing a swirl flow.

Consequently, a swirling chamber shape could be designed so that the following is implemented as with the design method for centrifugal blowers in Non-patent Document 1: the flow rata is conserved in the radial direction and in the circumferential direction in a swirling chamber.

However, the flow in a swirling chamber is opposite in a centrifugal blower and in a fuel injection valve. Therefore, the following are problems associated with swirling chamber designing based on the flow rate conservation in fuel injection valves: fuel flows from the joint between a swirling chamber and a passage for swirling in the direction of a fuel injection hole and hiders swirling; and the specifications of spray angle and particle diameter, which are characteristics of fuel injection valves, cannot be changed.

To solve the above problems, a fuel injection valve of the invention includes: a swirling chamber having an inner circumferential wall so formed that the curvature thereof is gradually increased from the upstream side to the downstream side; a passage for swirling for guiding fuel into the swirling chamber; and a fuel injection hole open in the swirling chamber. The swirling chamber has an inner wall surface comprised of a helical curve and the swirling chamber and the fuel injection hole are so formed that the following is implemented: the center of a circle making the basis of the helical curve and the center of the fuel injection hole open in the swirling chamber agree with each other. In this fuel injection valve, the joint between the passage for swirling and the inner circumferential wall on the downstream side of the swirling chamber where their walls intersect with each other is positioned between the following: a line segment drawn from the center of the fuel injection hole to the point at which the curvature of the swirling chamber shape starts to change; and the tangent line of the side wall of the fuel injection hole so drawn that it is parallel to the line segment. The radius of the swirling chamber shape is defined by a logarithmic spiral from flow rate conservation formulas in the radial direction and in the circumferential direction of the swirling chamber. The logarithmic spiral is a function of the width of the passage for swirling for guiding fuel into the swirling chamber and the distance from the center of the nozzle hole to the side wall of the passage for swirling.

In addition, the function includes as a variable the distance between the swirling chamber inner circumferential walls formed by the following according to the shape of the passage for swirling: the side wall of the passage for swirling connected to the downstream side of the swirling chamber or an extended line thereof; and the downstream side portion of the inner circumferential wall of the swirling chamber or an extended line thereof.

According to the invention, the following can be implemented while a certain degree of freedom in designing specifications such as spray angle and particle diameter is maintained: a swirling chamber shape in which the flow rate is conserved at each section in the radial direction and in the circumferential direction in a swirling chamber can be defined. Therefore, a swirl flow excellent in uniformity is formed in the swirling chamber. In addition, the influence of the inflow of fuel on a swirl flow is reduced by the position of installation of the joint.

This makes it possible to suppress variation in a fuel liquid film formed on the wall surface in a fuel injection hole and facilitate the atomization of fuel.

DETAILED DESCRIPTION OF THE PREFERRED EMBODIMENTS

Hereafter, a description will be given to embodiments with reference to the drawings. The upstream side and the downstream side cited in this specification refer to the upstream side and the downstream side of a fuel flow in a fuel injection valve.

First Embodiment

Figure 1:
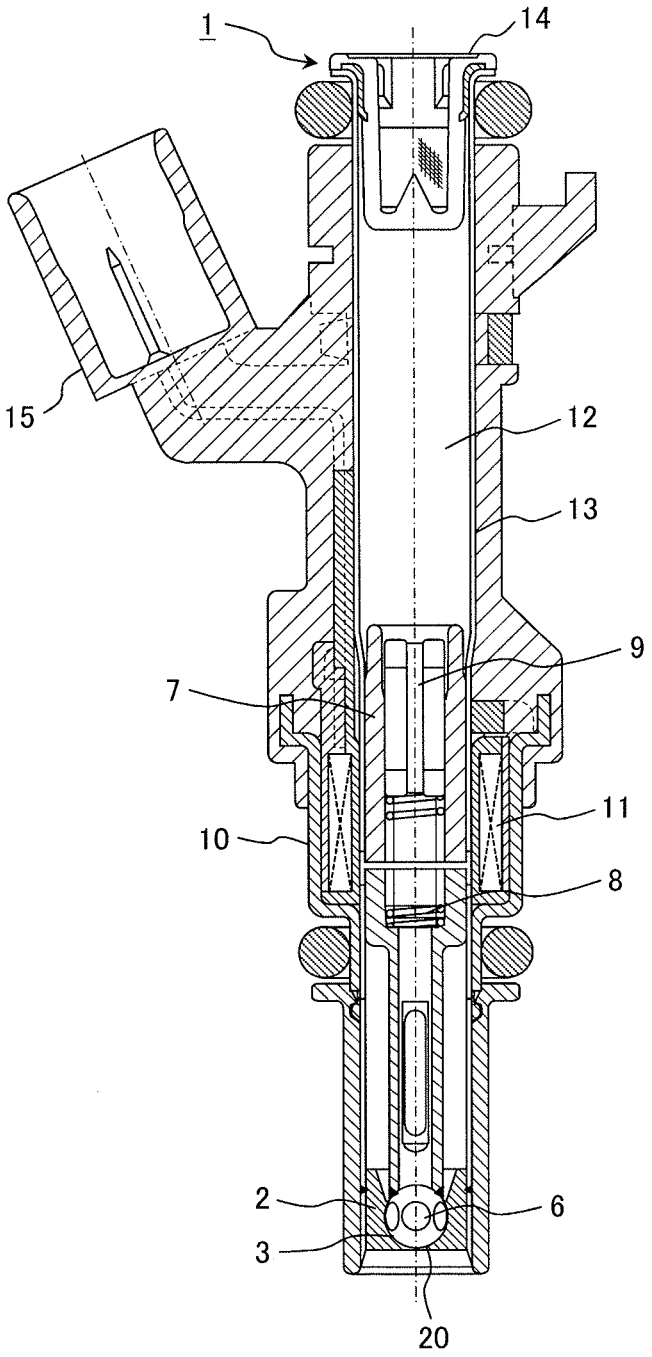
FIG. 1 is a longitudinal sectional view illustrating the overall configuration of a fuel injection valve of the invention in a section along the valve shaft center.

The following is a description of an embodiment of the invention. FIG. 1 is a longitudinal sectional view illustrating the overall configuration of a fuel injection valve 1 of the invention. In FIG. 1, the fuel injection valve 1 is formed by housing a nozzle body 2 and a valve body 6 in a thin-wall pipe 13 of stainless steel and is so configured that the valve body 6 is reciprocated (opened/closed) by an electromagnetic coil 11 placed outside. Hereafter, a detailed description will be given to this structure.

The fuel injection valve includes: a yoke 10 of magnetic material surrounding the electromagnetic coil 11; a core 7 positioned in the center of the electromagnetic coil 11, one end of which core being in magnetic contact with the yoke 10; the valve body 6 lifted by a predetermined amount; a valve seat face 3 in contact with the valve body 6; a fuel injection chamber 4 which allows the passage of fuel flowing through the gap between the valve body 6 and the valve seat face 3; and an orifice plate 20 having multiple fuel injection holes 23*a*, 23*b*, 23*c* (Refer to FIG. 2 to FIG. 4) positioned downstream of the fuel injection chamber 4.

The core 7 is provided in the center thereof with a spring 8 as an elastic member which presses the valve body 6 against the valve seat face 3. The elastic force of the spring 8 is adjusted by the amount by which a spring adjuster 9 is pushed toward the valve seat face 3.

When the coil 11 is not energized, the valve body 6 and the valve seat face 3 are in tight contact with each other. Since the fuel passage is closed in this state, fuel remains in the fuel injection valve 1 and is not injected from each of the multiple fuel injection holes 23*a*, 23*b*, 23*c*. When the coil 11 is energized, the valve body 6 is moved by electromagnetic force until it is brought into contact with the lower end face of the opposed core 7.

In this valve opened state, a gap is formed between the valve body 6 and the valve seat face 3; therefore, the fuel passage is opened and fuel is injected from each fuel injection hole 23*a*, 23*b*, 23*c*.

The fuel injection valve 1 is provided with a fuel passage 12 having a filter 14 at its inlet portion. This fuel passage 12 includes a through hole portion penetrating the central part of the core 7 and guides fuel pressurized by a fuel pump, not shown, to each fuel injection hole 23*a*, 23*b*, 23*c* through the interior of the fuel injection valve 1. The outside portion of the fuel injection valve 1 is covered with molding resin 15 and electrically insulated.

With respect to the action of the fuel injection valve 1, the fuel supply amount is controlled as follows. The position of the valve body 6 is switched between the valve opened state and the valve closed state as described above in conjunction with the energization (injection pulse) of the coil 11. For the control of fuel supply amount, the valve body is so designed that there is no fuel leakage, especially, in the valve closed state.

In this type of fuel injection valve, a mirror finished ball (steel ball for ball bearing conforming to the JIS standard) high in circularity is used for the valve body 6 and this is useful for the enhancement of seatability. The valve seat angle of the valve seat face 3 in which the ball is brought into tight contact is the optimum angle, 80° to 100°, at which excellent polishability is achieved and accurate circularity is obtained. At this angle, the above-mentioned seatability with the ball can be kept very high.

The nozzle body 2 including the valve seat face 3 is enhanced in hardness by quenching and useless magnetism is removed therefrom by demagnetization. This configuration of the valve body 6 enables injection quantity control without fuel leakage. Consequently, a valve body structure excellent in cost performance is obtained.

Figure 2:
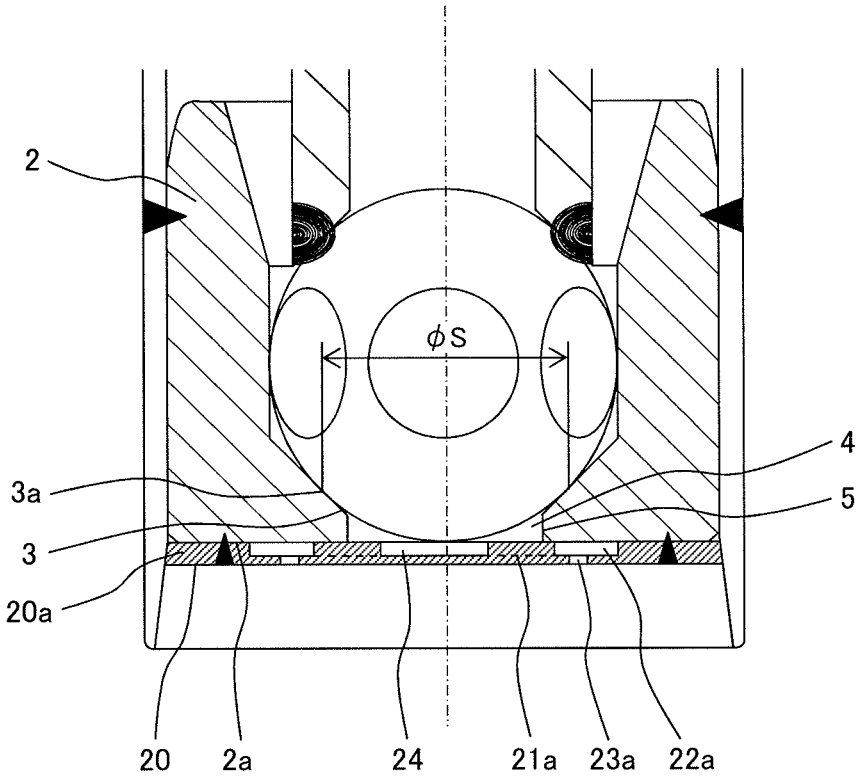
FIG. 2 is a longitudinal sectional view illustrating the proximity of the nozzle body in a fuel injection valve of the invention.

FIG. 2 is a longitudinal sectional view illustrating the proximity of the nozzle body 2 in a fuel injection valve 1 of the invention. As illustrated in FIG. 2, the orifice plate 20 has its upper surface 20*a* in contact with the lower surface 2*a* of the nozzle body 2 and is fixed to the nozzle body 2 by laser welding the circumference of this contact area.

The vertical direction cited in this specification and "What is claimed is" is based on FIG. 1. In the direction of the valve shaft center of the fuel injection valve 1, the fuel passage 12 side is taken as upper side and the fuel injection hole 23*a*, 23*b*, 23*c* side is taken as lower side.

The nozzle body 2 is provided at the lower end portion thereof with a fuel introduction hole 5 whose diameter is smaller than the diameter ϕS of the seat portion 3*a* of the valve seat face 3. The valve seat face 3 is in conical shape and the fuel introduction hole 5 is formed in the central part of its downstream end.

The valve seat face 3 and the fuel introduction hole 5 are so formed that the center line of the valve seat face 3 and the center line of the fuel introduction hole 5 agree with the valve shaft center. In the lower end face 2*a* of the nozzle body 2, an opening communicating with the central hole (center hole) 24 in the orifice plate 20 is formed by the fuel introduction hole 5.

Figure 3:
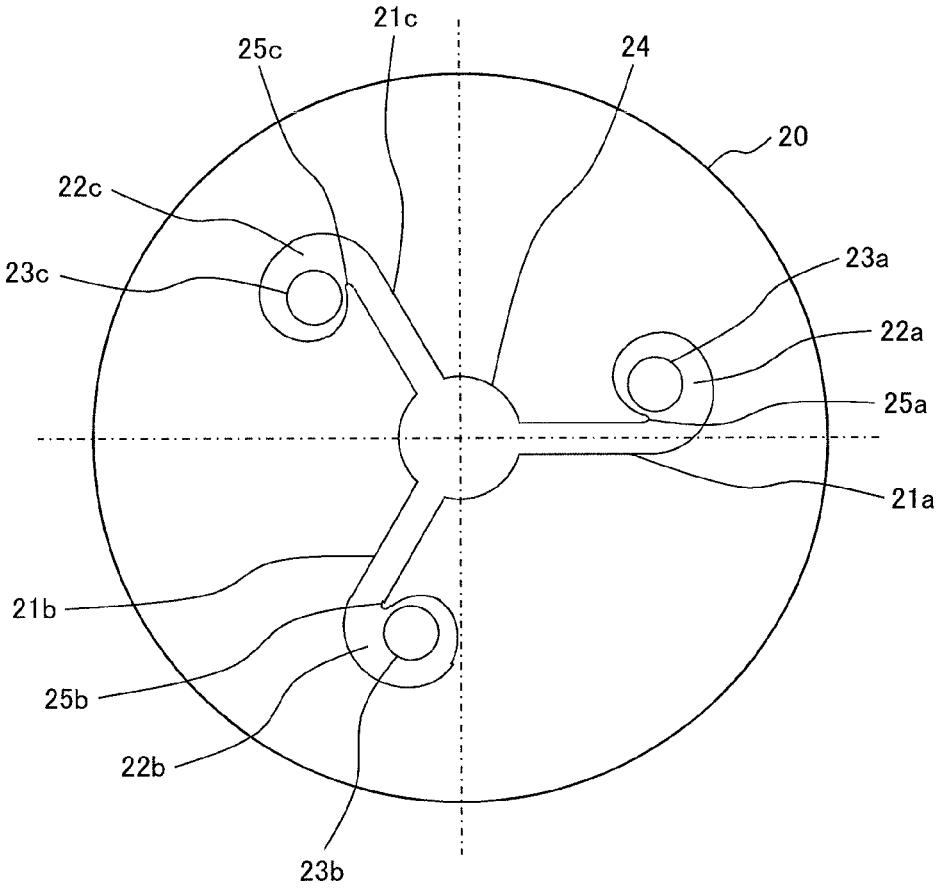
FIG. 3 is a plan view of an orifice plate positioned at the lower end portion of the nozzle body in a fuel injection valve of the invention.

A description will be given to the configuration of the orifice plate 20 with reference to FIG. 3. FIG. 3 is a plan view of the orifice plate 20 positioned at the lower end portion of the nozzle body 2 in a fuel injection valve 1 of the invention.

The center hole 24 is a recessed portion provided in the upper surface 20*a* of the orifice plate 20. The center hole 24 is connected with three passages 21*a*, 21*b*, 21*c* for swirling. The passages are placed at equal intervals (intervals of 120 degrees) in the circumferential direction of the center hole and are radially extended toward the outer circumferential side in the radial direction.

The downstream end of the passage 21*a* for swirling is so connected that it communicates with a swirling chamber 22*a*; the downstream end of the passage 21*b* for swirling is so connected that it communicates with a swirling chamber 22*b*; and the downstream end of the passage 21*c* for swirling is so connected that it communicates with a swirling chamber 22*c*.

The passages 21*a*, 21*b*, 21*c* for swirling are fuel passages supplying fuel to the swirling chambers 22*a*, 22*b*, 22*c*, respectively. In this sense, the passages 21*a*, 21*b*, 21*c* for swirling may be designated as swirling fuel supply passages 21*a*, 21*b*, 21*c*.

The wall surfaces of each swirling chamber 22*a*, 22*b*, 22*c* are so formed that their curvature is gradually increased (their curvature radius is gradually reduced) from the upstream side to the downstream side.

Fuel injection holes 23*a*, 23*b*, 23*c* are open in the centers of the swirling chambers 22*a*, 22*b*, 22*c*, respectively.

Though not shown in the drawing, the nozzle body 2 and the orifice plate 20 are so configured that they can be easily positioned using a jig or the like and this enhances the dimensional accuracy for assembling.

The orifice plate 20 is fabricated by press molding (plastic forming) advantageous to cutting or mass productivity. Aside from this method, methods, such as electric discharge machining, electroforming, and etching, in which applied stress is relatively low and high accuracy of finishing is achieved are available.

Swirling Chamber Shape with Flow Rate Conservation Taken into Account

A detailed description will be given to a method for forming a swirling chamber 22*a* with flow rate conservation taken into account with reference to FIG. 4.

One 21*a* of the passages for swirling communicates and is open in the tangential direction of the swirling chamber 22*a*. The fuel injection hole 23*a* is open so that the vortex central part of the swirling chamber 22*a* and the center of the fuel injection hole 23*a* agree with each other at the position marked with symbol O.

The inner circumferential wall of the swirling chamber 22*a* described in relation to this embodiment is so formed that the following curve is drawn in a plane (section) perpendicular to the valve shaft center line: a helical curve having a curvature that varies with the angle in the circumferential direction. However, the portion whose curvature varies in the inner circumferential wall shape of the passage 21*a* for swirling and the swirling chamber 22*a* is defined as "swirling chamber."

A description will be given to how to draw the inner circumferential wall face of the swirling chamber 22*a* formed by the above helical curve with reference to FIG. 4.

Figure 4:
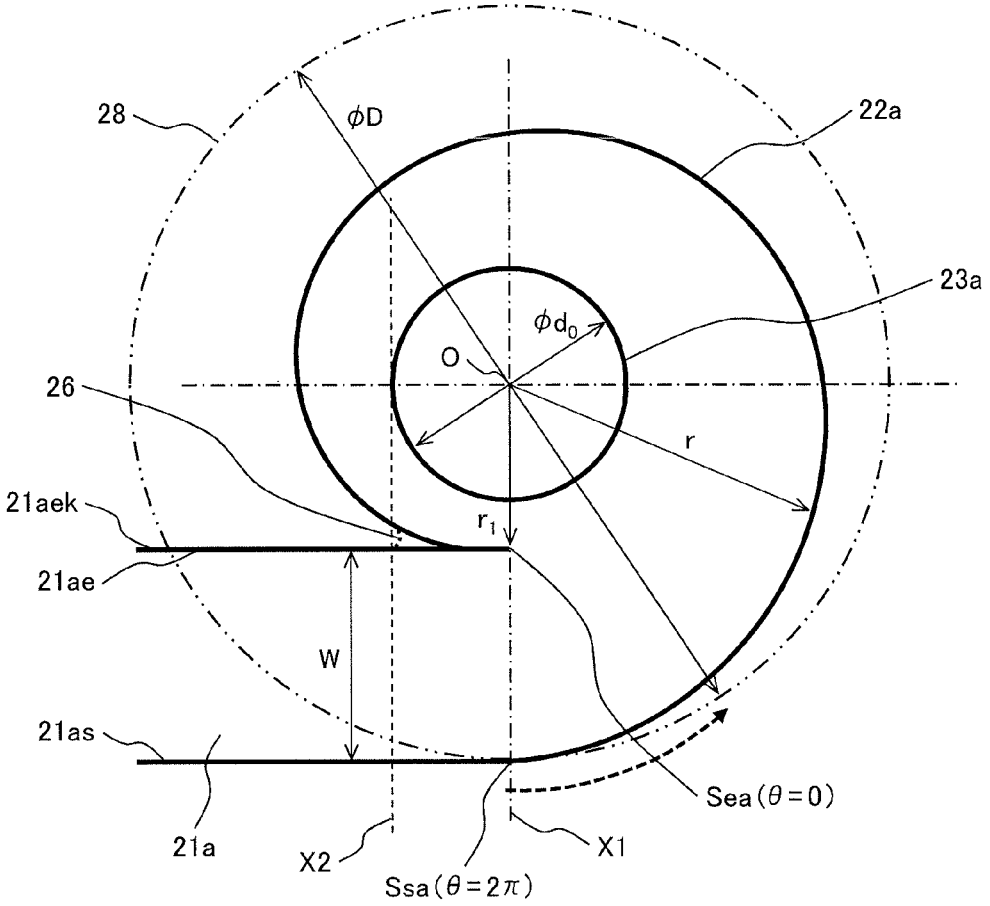
FIG. 4 is a drawing for explaining the details of a swirling chamber shape based on flow rate conservation in an orifice plate of the invention.

When a helical curve is drawn, usually, it is developed and depicted by the helix radius r being gradually increased from the starting point (equivalent to symbol O in FIG. 4 with respect to this embodiment). However, when a helical curve is used as the inner circumferential wall of a fuel passage for swirling fuel as in this embodiment, the following measure is taken to design it from the position of a fuel introduction flow path: for convenience sake, the leading edge (start point) Ssa is defined in the position of the upper course of a swirl and the terminal edge (endpoint) Sea is defined in the position of the lower course of a swirl. In this example, the fuel introduction passage is the passage 21*a* for swirling having passage width W.

Hereafter, a description will be given to a procedure for forming a wall surface comprised of a helical curve.

First, the following are extracted based on past experimental data and theoretical formulas in accordance with required flow rate and spray angle: the passage area of the passage 21*a* for swirling, the diameter $d_0$ of the fuel injection hole 23*a*, and the diameter D of a reference circle 28 as the basis of the size of the swirling chamber. As a result, the following are determined: the width W of the passage 21*a* for swirling, the height H of the passage 21*a* for swirling, the position of the center O of the swirling chamber, and the distance $r_1$ from the center O of the swirling chamber to the passage for swirling side wall 21*ae*.

Next, the side wall 21*as* of the passage 21*a* for swirling circumscribing the reference circle 28 is drawn. In this embodiment, the point of intersection between the reference circle 28 and the side wall 21*as* is taken as the leading edge (start point) Ssa of the swirling chamber shape 22*a*.

Subsequently, the other side wall 21*ae* of the passage 21*a* for swirling is drawn. The passage 21*a* for swirling is formed with width W allowed. There could be a case where the side walls 21*as* and 21*ae* are not in parallel to each other unlike the example in FIG. 4. In this case, the side wall 21*ae* is drawn so that the passage for swirling width W is the width W of the portion of coupling between the passage 21*a* for swirling and the swirling chamber 22*a*.

Here, the terminal edge (end point) Sea of the swirling chamber shape 22*a* is defined. The point at which the line segment 21*ae* and the swirling chamber shape 22*a* intersect with each is defined as Sea. However, since 22*a* has not been drawn yet as of this point in time, the position of Sea is indeterminate yet.

From the foregoing, the shape of the swirling chamber wall surface from the leading edge (start point) Ssa to the terminal edge (end point) Sea can be defined by the following logarithmic helical curve radius r: the logarithmic helical curve radius r expressed by Formulas (1) and (2) below derived from, for example, flow rate conservation formulas of the sections in the circumferential direction and in the radial direction of the swirling chamber.

$$r=r_1e^{\theta \tan \alpha} \quad \text{(Formula 1)}$$

$$\tan \alpha=1/(2\pi)\times 1n\{(r_1+W)/r_1\} \quad \text{(Formula 2)}$$

In the formula, θ represents the circumferential angle [radian] of the swirling chamber 22*a*. The joint between the wall surface on the downstream side of the swirling chamber 22*a* and the side wall 21*ae* of the passage for swirling is positioned between the following as illustrated in FIG. 4: it is positioned between the line segment X1 going from the fuel injection hole 23*a* to the leading edge (start point) Ssa of the helical curve and the line segment X2 drawn in contact with the fuel injection hole 23*a* so that it is in parallel to the line segment X1. That is, the joint is positioned between the leading edge (start point) Ssa of the helical curve and the limit position 26 of the joint illustrated in the drawing. The joint between wall surfaces is connected by a curved surface like the joint 26. The fuel injection hole 23*a* is so defined that its diameter is $d_0$ and the swirling chamber center O is taken as its center.

As the result of the passage 21*a* for swirling, swirling chamber 22*a*, fuel injection hole 23*a* being defined as mentioned above, the following takes place: fuel flowing in from the passage 21*a* for swirling is swirled in the swirling chamber 22*a*; and after it flows into the fuel injection hole 23*a*, it is swirled in the fuel injection hole 23*a* and discharged into the atmospheric region.

The shape of the swirling chamber is defined by using the following as design values for defining the swirling chamber shape as mentioned above: the diameter D of the reference circle 28, the width W of the passage 21*a* for swirling, and the distance $r_1$ from the center O of the swirling chamber to the passage for swirling side wall 21*ae*. The height H of the passage 21*a* for swirling and the diameter $d_0$ of the fuel injection hole 23*a* are considered as design values which are not related to the swirling chamber shape. As a result, the flow rate of fuel, spray angle, and particle diameter can be adjusted.

Further, the position of the joint between the wall surface on the downstream side of the swirling chamber 22*a* and the side wall 21*ae* of the passage for swirling is located between the leading edge (start point) Ssa of the helical curve and the limit position 26 of the joint shown in the drawing. As a result, such a shape that a flow from the passage 21*a* for swirling does not directly go into the fuel injection hole 23*a* is formed. This suppresses a flow going around in the swirling chamber from being hindered by a flow from a passage for swirling and a swirl flow from becoming uneven.

Inclination of Fuel Injection Hole

In this embodiment, the opening direction (fuel outflow direction, central axis line direction) of each of the fuel injection holes 23*a*, 23*b*, 23*c* is in parallel to the valve shaft center of the fuel injection valve 1 and goes downward. Instead, the invention may be so configured that the direction is inclined from the valve shaft center to a desired direction to diffuse sprays (the individual sprays are separated from one another to suppress the interference between sprays).

Cases where Fuel Injection Valve has Multiple Fuel Injection Holes

The following relations are the same as the above-mentioned relation between the passage 21*a* for swirling, swirling chamber 22*a*, and fuel injection hole 23*a*: the relation between the passage 21*b* for swirling, swirling chamber 22*b*, and fuel injection hole 23*b*; and the relation between the passage 21*c* for swirling, swirling chamber 22*c*, and fuel injection hole 23*c*. Therefore, the description thereof will be omitted.

Figure 9:
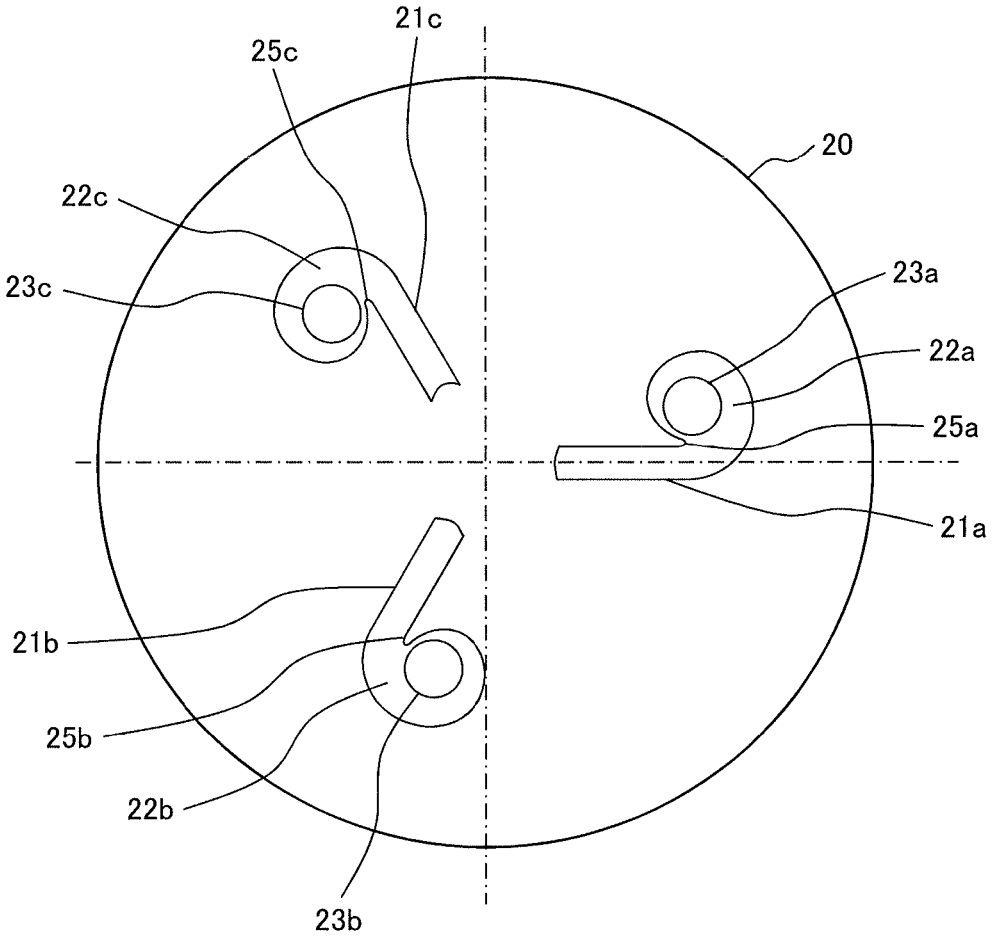
FIG. 9 is a plan view of an orifice plate of the invention in which fuel passages are not connected with one another.
Figure 10:
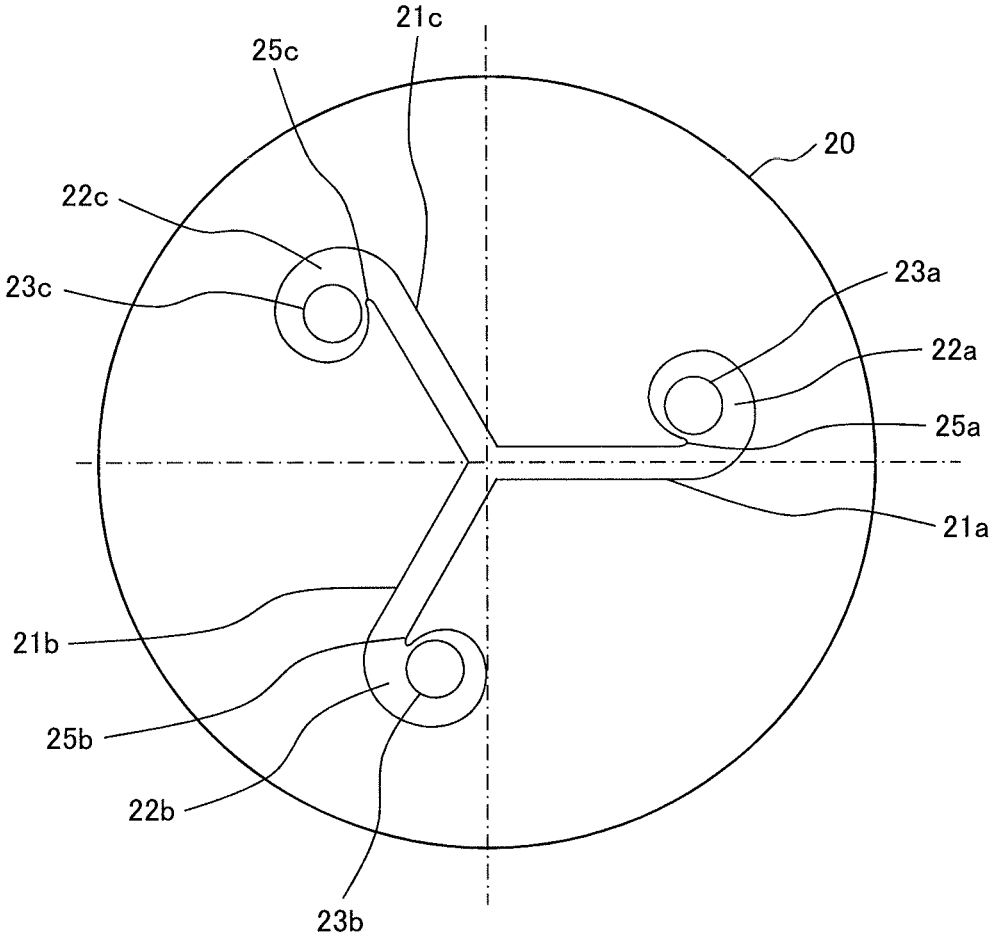
FIG. 10 is a plan view of an orifice plate of the invention in which the center hole is not provided.

This embodiment is provided with three sets of fuel passages obtained by combining a passage 21 for swirling, a swirling chamber 22, and a fuel injection hole 23. The number of sets may be further increased as illustrated in FIG. 9 to enhance the degree of freedom in variety of spray shape and injection quantity. The number of sets of fuel passages obtained by combining a passage 21 for swirling, a swirling chamber 22, and fuel injection hole 23 may be two or one.

Second Embodiment

Formation of Thickness Required for Machining and Influence on Flow Field

Figure 5:
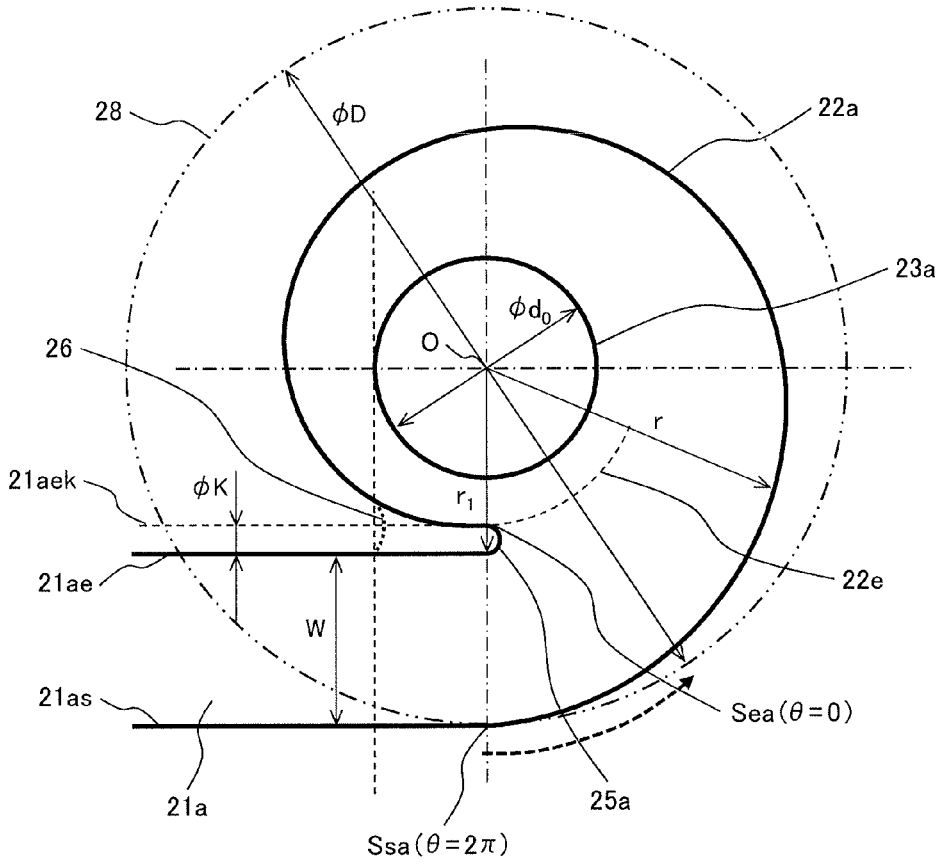
FIG. 5 is a drawing for explaining a swirling chamber shape with the shape of the joint between the swirling chamber and the passage for swirling taken into account in an orifice plate of the invention.

A description will be given to a thickness 25*a* required for machining formed in the joint between the passage 21*a* for swirling and the swirling chamber 22*a* with reference to FIG. 5. FIG. 5 illustrates the relation between the passage 21*a* for swirling, swirling chamber 22*a*, and fuel injection hole 23*a*.

With respect to an extended line of the side wall (wall surface along the height direction) 21*ae* of the passage 21*a* for swirling, the following is avoided: the extended line intersects with an extended line 22*e* of the helical curve drawn by the inner circumferential wall of the swirling chamber 22*a* within the range of the following angle: an angle formed by rotation (swirling) of 180 degrees or more from the start point Ssa of the helical curve. As a result, 25*a* which is a virtual thickness can be formed between the side wall 21*ae* and the helical curve drawn by the inner circumferential wall of the swirling chamber 22*a*.

The circular portion 25*a* which is a thickness required for machining is formed throughout in the direction of height (direction along the central axis of swirling) of the passage 21*a* for swirling and the swirling chamber 22*a*. Therefore, it comprises a partial columnar portion configured within a predetermined range of angle in the circumferential direction.

The presence of this thickness forming portion 25*a* prevent a pointed sharp shape like a knife edge from being formed. Therefore, even if minute positional deviation occurs in this area, interference between fuel going round in the swirling chamber 22*a* and fuel flowing in from the passage 21*a* for swirling is mitigated. Consequently, there is not a rapid drift to the fuel injection hole 23*a* side and the symmetry (uniformity) of a swirl flow is ensured.

Swirling Chamber Shape with Thickness Forming Portion Taken into Account

A detailed description will be given to a method for forming the swirling chamber 22*a* with the thickness forming portion 25*a* taken into account with reference to FIG. 5. The description of each part has been given with reference to FIG. 4 in relation to a first embodiment and will be omitted.

Hereafter, a description will be given to a procedure for forming a wall surface composed of a helical curve with the thickness forming portion taken into account.

How to determine each design value has been described with reference to FIG. 4 in relation to the first embodiment and the description thereof will be omitted.

First, the side wall 21*as* of the passage 21*a* for swirling circumscribing the reference circle 28 is drawn. In this embodiment, the point of intersection between the reference circle 28 and the side wall 21*as* is taken as the leading edge (start point) Ssa of the swirling chamber shape 22*a*.

Subsequently, the other side wall 21*ae* of the passage 21*a* for swirling is drawn. The passage 21*a* for swirling is formed with width W allowed. There could be a case where the side walls 21*as* and 21*ae* are not in parallel to each other unlike the example in FIG. 5. In this case, the side wall 21*ae* is drawn so that the passage for swirling width W is the width of the portion of coupling between the passage 21*a* for swirling and the swirling chamber 22*a*.

Next, the thickness ϕK required for machining the inner circumferential wall surface of the swirling chamber is defined.

The swirling chamber shape 22*a* is defined by the logarithmic helical curve radius r incorporating the thickness ϕK required for machining the inner circumferential wall surface of the swirling chamber using the parameters defined above. It is drawn, for example, so that the relation expressed by Formulas (3) and (4) below is met.

$$r=(r_1-\phi K)e^{\theta \tan \alpha} \quad \text{(Formula 3)}$$

$$\tan \alpha=1/(2\pi)\times 1n\{(r_1+W)/(r_1-\phi K)\} \quad \text{(Formula 4)}$$

The swirling chamber shape given by Formula (3) and Formula (4) is a shape so given that the thickness ϕK required for machining is taken into account and the flow rate is equal at each section in the swirling chamber. In the formula, θ represents the circumferential angle [radian] of the swirling chamber 21*a*. This makes it possible to enhance the efficiency of a swirl flow as compared with conventional swirling chamber shapes defined without the thickness ϕK for machining taken into account. However, Formulas (3) and (4) are formulas in which the parameter of each part is defined as in FIG. 5 and the shape of a swirling chamber of the invention is not necessarily expressed by the same formulas. Using an involute curve, arithmetic spiral, or the like as a curve as the basis also makes the shape of a swirling chamber different. Incorporating ϕK into its curvature brings about the effect of the uniformization of swirl flows.

Here, the terminal edge (end point) Sea of the swirling chamber shape 22*a* is defined. A line segment 21*aek* parallel to the side wall 21*ae* with a distance ϕK in-between is drawn. The point at which the line segment 21*aek* and the swirling chamber shape 22*a* intersect with each other is defined as Sea. There are two points of intersection between the swirling chamber shape 22*a* and the line segment 21*aek* depending on the value of ϕK and either point can be taken as Sea.

From the foregoing, the visible outline of the swirling chamber shape wall surface can be drawn from the leading edge (start point) Ssa to the terminal edge (end point) Sea. The thickness forming portion 25*a* which is the joint between the swirling chamber 22*a* and the side wall 21*ae* of the passage for swirling is connected by a curved surface as illustrated in FIG. 5. The fuel injection hole 23*a* is so defined that its diameter is $d_0$ and the swirling chamber center O is taken as its center.

As the result of the passage 21*a* for swirling, swirling chamber 22*a*, and fuel injection hole 23*a* being defined as mentioned above, the following takes place: fuel flowing in from the passage 21*a* for swirling is swirled in the swirling chamber 22*a*; and after it flows into the fuel injection hole 23*a*, it is swirled in the fuel injection hole 23*a* and discharged into the atmospheric region. In this embodiment, the shape of the swirling chamber 22*a* is defined with the thickness forming portion 25*a* taken into account; therefore, a swirl flow uniform as compared with conventional cases is formed and variation in the liquid film thickness of fuel formed in the fuel injection hole 23*a* is reduced. As a result, the coarse particles of sprays are less prone to be produced and atomization is facilitated.

Figure 6:
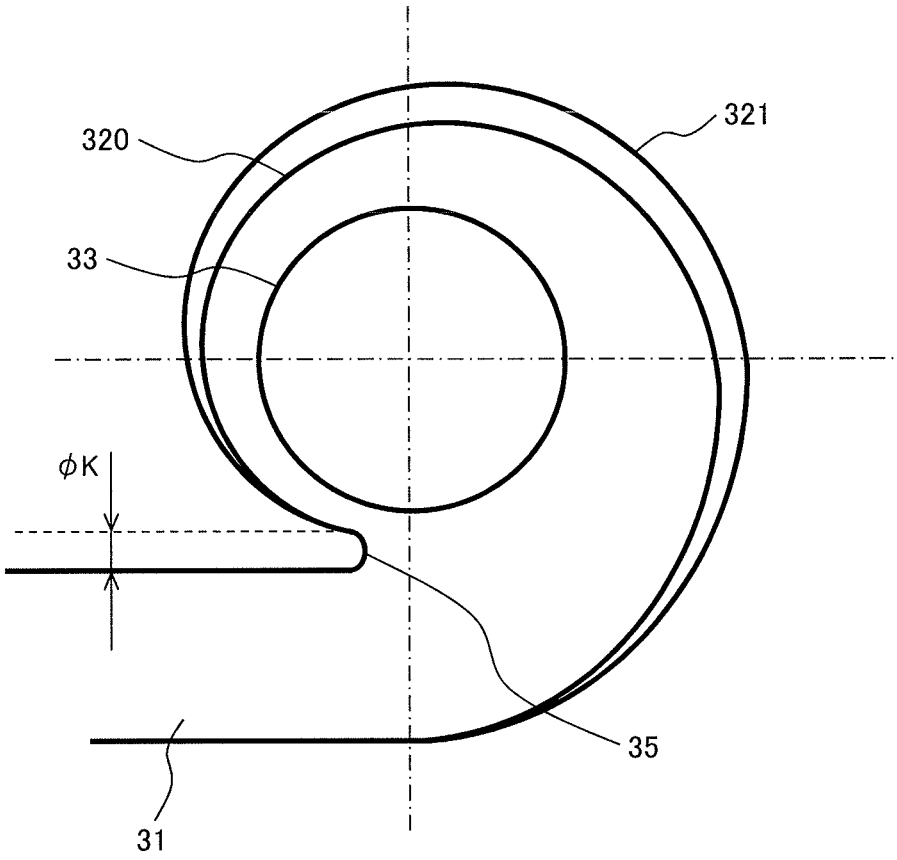
FIG. 6 is a drawing for explaining the difference between a conventional swirling chamber shape and the shape of the swirling chamber of the invention in an orifice plate of the invention.

FIG. 6 is comprised of a passage 31 for swirling, swirling chambers 320, 321, a fuel introduction passage 33, and a thickness forming portion 35. To verify the atomization effect of the swirling chamber shape in this embodiment, the Sauter's mean diameter of fuel sprays was measured in the following: a swirling chamber shape 321 based on the arithmetic spiral illustrated in FIG. 6 and a swirling chamber shape 320 defined by Formulas (3) and (4) based on flow rate conservation. The following is the result of the measurement. In the swirling chamber shape 320 in this embodiment, the particle diameter was improved approximately 4% at an identical flow rate. This is because the swirling chamber shape in this embodiment is based on flow rate conservation and swirl flows are efficiently formed and coarse droplets are less prone to be contained in sprayed fuel.

As described above, more efficient swirling can be achieved by taking flow rate conservation into account as expressed by Formulas (3) and (4) to design the shape of the swirling chamber 320.

Figure 7A:
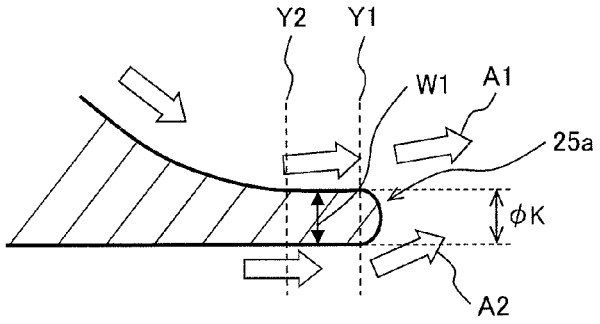
FIG. 7A is an enlarged view of a thickness forming portion formed in a shape in accordance with flow rate conservation formulas.
Figure 7B:
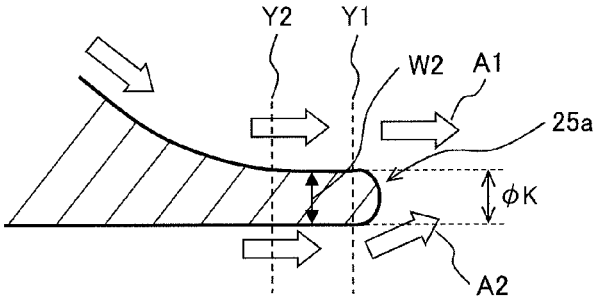
FIG. 7B is an enlarged view of a thickness forming portion whose width is linearly formed.
Figure 7C:
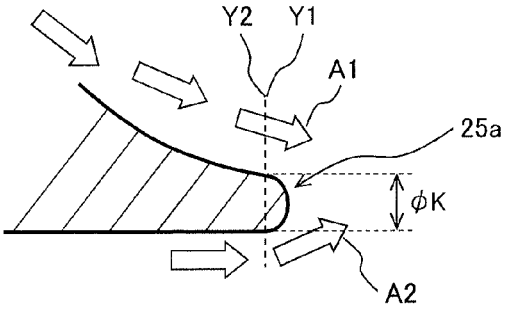
FIG. 7C is an enlarged view of a thickness forming portion so formed that it is not extended to the inlet of a swirling chamber.
Figure 8A:
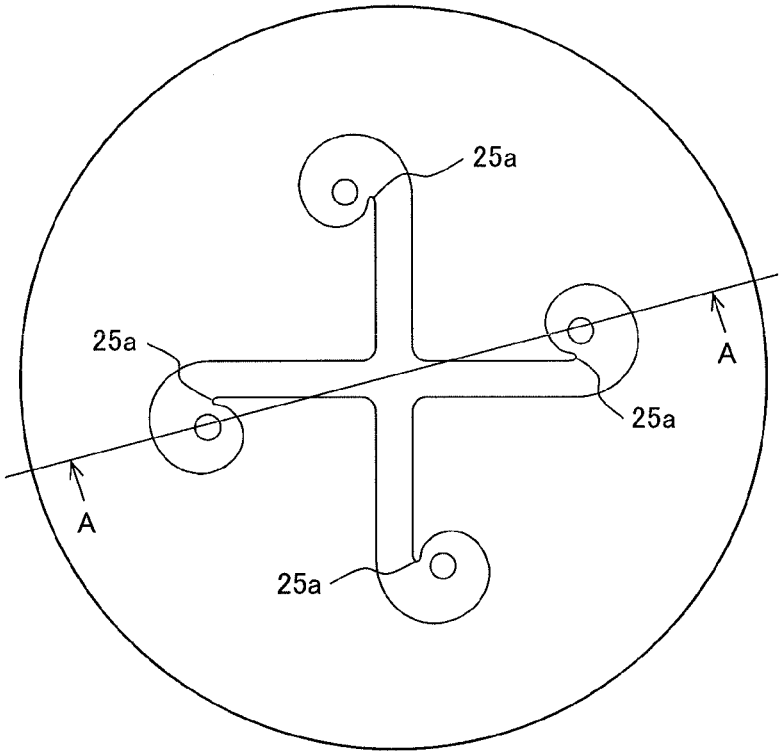
FIG. 8A is a plan view of an orifice plate of the invention in which four fuel injection holes are provided.
Figure 8B:
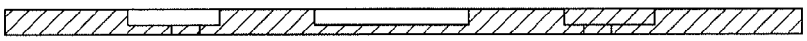
FIG. 8B is a sectional view taken along line A-A of FIG. 8A.

Efficient swirling can be achieved by variously deforming the thickness forming portion 25*a* as illustrated in FIGS. 7A to 7C. In the preferred mode in FIG. 7A in which the wall surface thickness W1 between the line segment Y1 and the line segment Y2 is smaller than ϕK, a flow rate conservation shape is formed. For this reason, the wall surface can smooth the swirl flow A1 of fuel and guide it into the fuel injection hole 23*a*. Since the thickness forming portion 25*a* is extended to the line segment Y1, it is possible to reduce interference between fuel A1 flowing in the swirling chamber 22*a* and fuel A2 flowing in the passage 21*a* for swirling. Y1 cited here refers to the position of the inlet of the swirling chamber at which the curvature is varied for forming the edge of the thickness forming portion 25*a*. Y2 refers to a position at which the inner wall surface of the swirling chamber 22*a* gradually brought close to the passage 21*a* for swirling takes ϕK identical with the wall surface thickness of the thickness forming portion 25*a*.

In the example in FIG. 7B, the wall surface thickness W2 between the line segment Y1 and the line segment Y2 takes ϕK. In other words, the line segments Y1 and Y2 are connected with each other by a straight line. For this reason, robustness can be ensured when the wall surface is machined. Since the thickness forming portion 25*a* is extended to the line segment Y1, it is possible to reduce interference between fuel A1 flowing in the swirling chamber 22*a* and fuel A2 flowing in the passage 21*a* for swirling.

In the example in FIG. 7C, the thickness forming portion 25*a* is not extended to the line segment Y1 (that is, Y1=Y2). For this reason, higher robustness can be ensured than in the example in FIG. 7B when the wall surfaces are machined. With respect to the inclination of the fuel injection holes, this example is the same as the first embodiment. Also when the fuel injection valve has multiple fuel injection holes, this example is the same as the first embodiment.

Control of Spray Shape by Design of Swirling Chamber

When a fuel injection valve is actually developed as a product, not only the fuel atomization performance but also the following are required: the adjustment of spray angle according to the intake port shape of an engine and a dimensional design excellent in the robustness of flow rate for mass production. In the swirling chamber shapes described in relation to the above embodiments, the spray angle can be narrowed, for example, by increasing the cross-sectional area of the passages for swirling and reducing the reference circle 28 of the helical curve. In addition, the robustness of flow rate can be improved by reducing the aspect ratio W/H of the passages for swirling. As described above, another advantage of the design technique of the invention is that efficient swirling can be achieved and yet the degree of freedom in designing for specifications required of fuel injection valves is high.

What is claimed is:

1. A fuel injection valve comprising:

a swirling chamber having an inner circumferential wall so formed that a curvature thereof is gradually increased from an upstream side to a downstream side;

a passage that is configured to swirl and guide fuel into the swirling chamber; and a fuel injection hole that is open in the swirling chamber, wherein a joint between the passage and the inner circumferential wall on the downstream side of the swirling chamber at which both walls intersect with each other exists within a range from a center of the fuel injection hole to a side wall of the fuel injection hole, the shape of the inner circumferential wall of the swirling chamber is defined from flow rate conservation formulas in a radial direction and in a circumferential direction of the swirling chamber by a logarithmic spiral which is a function of a width of the passage and a distance from a center of a nozzle hole to a side wall of the passage, a thickness formation part is formed between an end of an inner circumferential surface of the swirling chamber of a side in which a curvature becomes large, and a downstream end of a side wall of a swirling path which is connected to the end of the inner circumferential surface of the swirling chamber, and a shape of the swirling chamber is defined by the following formulas $$r=(r_1-\phi K)e^{\theta \tan \alpha},$$

and $$\tan \alpha=1/(2\pi)\times 1n\{(r_1+W)/(r_1-\phi K)\}.$$

2. The fuel injection valve according to claim 1, wherein the function of the logarithmic spiral drawing the shape of the inner circumferential wall of the swirling chamber includes as a variable the distance between the swirling chamber inner circumferential walls formed by the side wall of the passage connected to the downstream side of the swirling chamber or an extended line thereof and the downstream side portion of the inner circumferential wall of the swirling chamber or an extended line thereof and the fuel injection valve has the shape of the inner circumferential wall of the swirling chamber defined by the function.

3. The fuel injection valve according to claim 1, wherein of both side walls positioned at both the ends of the passage in the width direction, one side wall is provided in the direction of the tangent line in contact at a start point with a reference circle going through the start point of the logarithmic spiral established at the end on the upstream side of the inner circumferential wall of the swirling chamber and the other side wall is connected with the downstream side end of the inner circumferential wall.

4. The fuel injection valve according to claim 3, wherein the joint between the other side wall of the passage and the downstream side end of the inner circumferential wall is positioned between a first line segment going through the center of the fuel injection hole and the start point of the logarithmic spiral and a second line segment which is a line segment parallel to the first line segment and is in contact with an inlet opening edge of the fuel injection hole and positioned on the passage side with respect to the first line segment.

5. The fuel injection valve according to claim 3, wherein the other side wall or an extended line thereof does not intersect with the inner circumferential wall or an extended line thereof in a position where the logarithmic spiral is rotated 180° or more and the other side wall and an extended line thereof and the inner circumferential wall and an extended line thereof are at a distance from each other in a position where the other side wall and an extended line thereof and the inner circumferential wall and an extended line thereof are brought closest to each other.

6. The fuel injection valve according to claim 4, wherein the other side wall or an extended line thereof does not intersect with the inner circumferential wall or an extended line thereof in a position where the logarithmic spiral is rotated 180° or more and the other side wall and an extended line thereof and the inner circumferential wall and an extended line thereof are at a distance from each other in a position where the other side wall and an extended line thereof and the inner circumferential wall and an extended line thereof are brought closest to each other.

* * * * *